US011013654B2

(12) United States Patent
Wallin

(10) Patent No.: US 11,013,654 B2
(45) Date of Patent: May 25, 2021

(54) OVERHEAD LIFT SYSTEMS FOR MOUNTING AND DISMOUNTING LIFT UNITS ON AN OVERHEAD RAIL

(71) Applicant: Liko Research & Development AB, Luleå (SE)

(72) Inventor: Jonas Wallin, Luleå (SE)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 489 days.

(21) Appl. No.: 15/981,973

(22) Filed: May 17, 2018

(65) Prior Publication Data

US 2018/0344554 A1 Dec. 6, 2018

Related U.S. Application Data

(60) Provisional application No. 62/512,890, filed on May 31, 2017.

(51) Int. Cl.
*A61G 7/10* (2006.01)
*B66B 9/08* (2006.01)

(52) U.S. Cl.
CPC ..... *A61G 7/1042* (2013.01); *A61G 7/1015* (2013.01); *B66B 9/0861* (2013.01); *A61G 7/1051* (2013.01); *A61G 7/1063* (2013.01)

(58) Field of Classification Search
CPC .. A61G 7/1042; A61G 7/1015; A61G 7/1051; A61G 7/1063; B66B 9/0861
See application file for complete search history.

(56) References Cited

U.S. PATENT DOCUMENTS 6,079,578 A * 6/2000 Dyson ..... A61G 7/1015 104/89
6,341,393 B1 * 1/2002 Votel ..... A61G 7/1015 5/484
8,978,905 B2 * 3/2015 Bergenstråle ..... A61G 7/1042 212/324
10,478,360 B2 * 11/2019 Andersson ..... A61G 7/10
10,555,856 B2 * 2/2020 Chandan ..... A61G 7/1015
10,561,558 B2 * 2/2020 Kaikenger ..... A61G 7/1061
(Continued)

FOREIGN PATENT DOCUMENTS

DE 3636440 C1 10/1987
JP 09028741 A 2/1997
(Continued)

OTHER PUBLICATIONS

European Search Report dated Dec. 14, 2018 for EP Application No. 18175230.4, 7 pages.

*Primary Examiner* — Jason C Smith
(74) *Attorney, Agent, or Firm* — Dinsmore & Shohl LLP

(57) ABSTRACT

An overhead lift system for supporting a person with a lift unit includes an overhead rail and an elevator track. The overhead rail includes a subject support portion and a docking portion. An end of the docking portion is removably coupled to an end of the subject support portion. The elevator track is coupled to the docking portion of the overhead rail. The elevator track is configured to convey the docking portion of the overhead rail from a height of the subject support portion of the overhead rail toward a position below the height of the subject support portion of the overhead rail.

20 Claims, 14 Drawing Sheets

(56) References Cited

U.S. PATENT DOCUMENTS

| | | | | |
|---|---|---|---|---|
| 2012/0137442 | A1* | 6/2012 | Lagana | A61G 7/1038 5/662 |
| 2015/0096119 | A1* | 4/2015 | Boyle | A61G 7/1015 5/87.1 |
| 2018/0071159 | A1* | 3/2018 | Glukhovsky | A63B 69/0064 |
| 2018/0344554 | A1* | 12/2018 | Wallin | B66B 9/0861 |

FOREIGN PATENT DOCUMENTS

| | | | | |
|---|---|---|---|---|
| JP | 10286288 | A * | 10/1998 | A61G 7/1061 |
| JP | 10286288 | A | 10/1998 | |
| WO | 2011059339 | A1 | 5/2011 | |

* cited by examiner

OVERHEAD LIFT SYSTEMS FOR MOUNTING AND DISMOUNTING LIFT UNITS ON AN OVERHEAD RAIL

CROSS-REFERENCE TO RELATED APPLICATION

This application claims the benefit of priority to U.S. Provisional Application Ser. No. 62/512,891, filed May 31, 2017.

TECHNICAL FIELD

The present specification generally relates to overhead lift systems, and, more specifically, to overhead lift systems for mounting and dismounting lift units on an overhead rail.

BACKGROUND

Overhead lifting devices, or lift units, such as subject lifts used in the health care industry, may generally be coupled to an overhead rail system with a carriage which facilitates positioning the lift unit with respect to the overhead rail. Sometimes it may be desirable to dismount the lift unit from the overhead rail system and transport the lift unit to a different overhead rail system that may not be connected to the first overhead rail system. Alternatively, it may be necessary to dismount the lift unit from the overhead rail system to service the lift unit. Because the lift units are generally suspended well-above the ground on the overhead rail system, ladders or other such structures may be required to allow an operator or service person to reach the lift unit to manually remove it from the overhead rail. Such methods of removal may be unstable and lead to possible injury or damage to the lift unit.

Accordingly, a need exists for alternative overhead lift systems to facilitate mounting and dismounting a lift unit on an overhead rail system.

SUMMARY

In one embodiment, an overhead lift system for supporting a person with a lift unit may include an overhead rail and an elevator track. The overhead rail may include a subject support portion and a docking portion. An end of the docking portion may be removably coupled to an end of the subject support portion. The elevator track may be coupled to the docking portion of the overhead rail. The elevator track is configured to convey the docking portion of the overhead rail from a height of the subject support portion of the overhead rail toward a position below the height of subject support portion of the overhead rail.

In another embodiment, an overhead lift system may include an overhead rail, an elevator track and a lift unit. The overhead rail includes a subject support portion, a docking portion, and a transit switch portion. An end of the docking portion is coupled to an end of the subject support portion with the transit switch. The elevator track is coupled to the docking portion such that the docking portion is moveable on the elevator track with respect to the overhead rail. The elevator track is configured to convey the docking portion of the overhead rail from a height of the subject support portion of the overhead rail toward a position below the height of the subject support portion of the overhead rail. The lift unit is slidably engaged with the overhead rail. When the lift unit is positioned within the docking portion, the docking portion is configured to convey the lift unit along the elevator track.

The transit switch portion includes a deformable material that interfaces with the lift unit as the lift unit travels through the transit switch portion. The deformable material deforms upon application of a load above a predetermined amount and prevents the lift unit from entering the docking portion of the overhead rail when the load of the lift unit is above a predetermined amount.

In yet another embodiment, a kit of parts for retrofitting an overhead rail to facilitate raising and lowering a lift unit to and from the overhead rail includes a docking portion of the overhead rail, a transit switch portion of the overhead rail, and an elevator track. The transit switch portion couples the docking portion of the overhead rail to an end of a subject support portion of the overhead rail. The elevator track is coupled to the docking portion such that the docking portion is translatable on the elevator track with respect to the subject support portion of the overhead rail.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments disclosed herein include overhead lift systems and methods that allow for lift units, such as subject lift units used in care settings such as hospitals for example, to be mounted and dismounted from overhead rails of the overhead lift system. Specifically, embodiments described herein include an overhead rail that includes a subject support portion and a docking portion. The docking portion is removably coupled to an end of the subject support portion. An elevator track is coupled to the docking portion such that the docking portion is moveable on the elevator track with respect to the subject support portion of the overhead rail. The elevator track is configured to convey the docking portion of the overhead rail from a height of the subject support portion of the overhead rail toward a position below the height of the subject support portion of the overhead rail. Such structure can facilitate the raising and lowering of a lift unit with respect to the subject support portion of the overhead rail. Specifically, a lift unit can be passed into the docking portion and, with the docking portion, descend from a height of the subject support portion of the overhead rail to a height below that of the subject support portion of the overhead rail. Once at a desired height below the height of the subject support portion of the overhead rail, the lift unit can be removed from the docking portion and transported to another location or serviced. In this way, the lift unit can be first lowered to a height where the lift unit is more easily accessible instead of needing ladders or other structures to allow an operator to ascend to a height of the overhead rail system and manually remove a lift unit from an overhead rail. Various embodiments of the overhead lift systems will be described in more detail herein with specific reference to the corresponding drawings.

Figure 1:
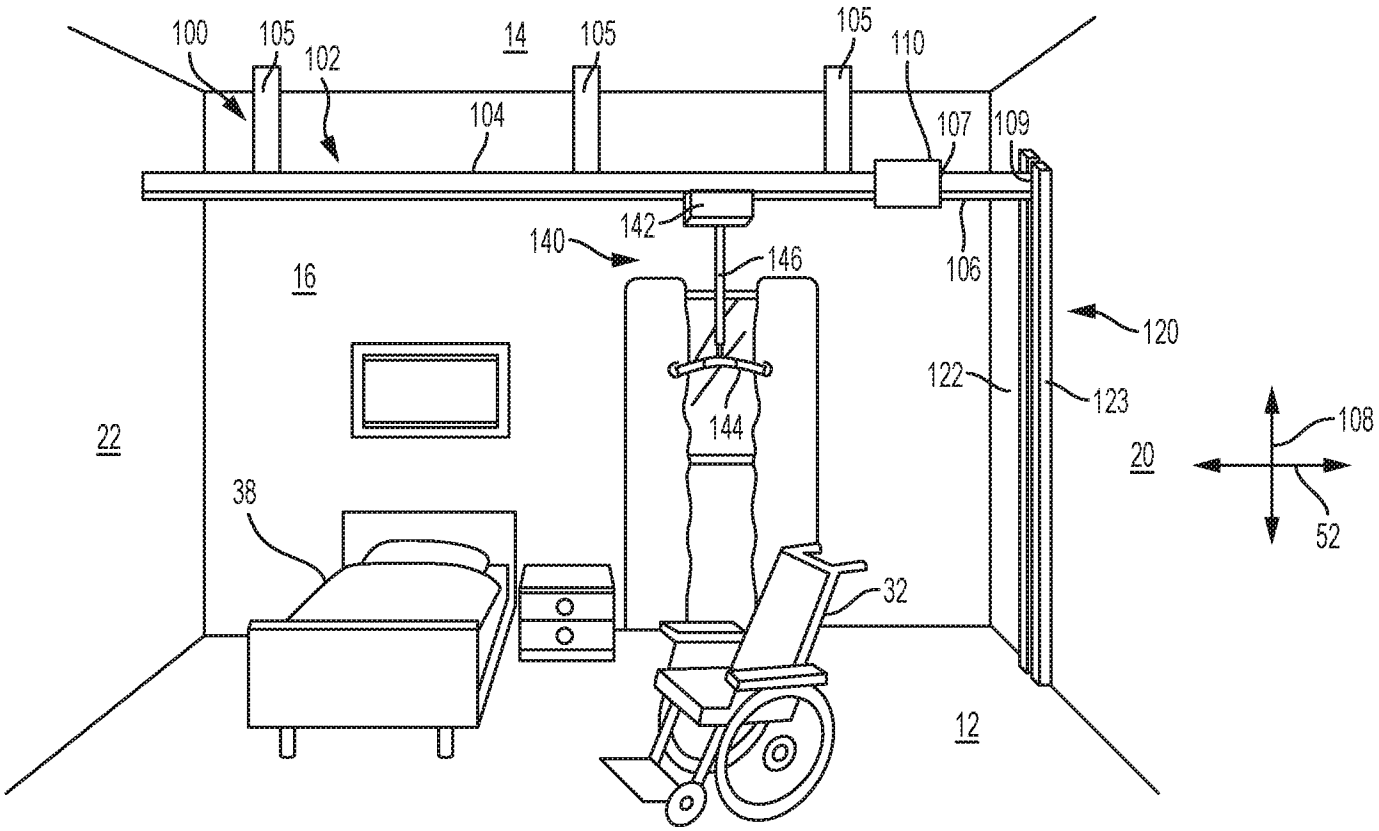
FIG. 1 schematically depicts a perspective view of a room showing elements of an overhead lift system, according to one or more embodiments shown and described herein.

FIG. 1 depicts a care room having a floor 12, a ceiling 14, and architectural walls 16, 20, 22. The care room may also include a fourth wall (not shown). Such care rooms may include various objects such as a bed 38, a wheel chair 32, and the like. As illustrated, the care room may include an overhead lift system 100 that may be used, for example, to transport a subject to various locations within the care room or elsewhere in the facility. In the embodiments described herein, the overhead lift system 100 may include a lift unit 140, an overhead rail 102, and an elevator track 120. These and additional features of the overhead lift system 100 will be described in greater detail herein.

Figure 2:
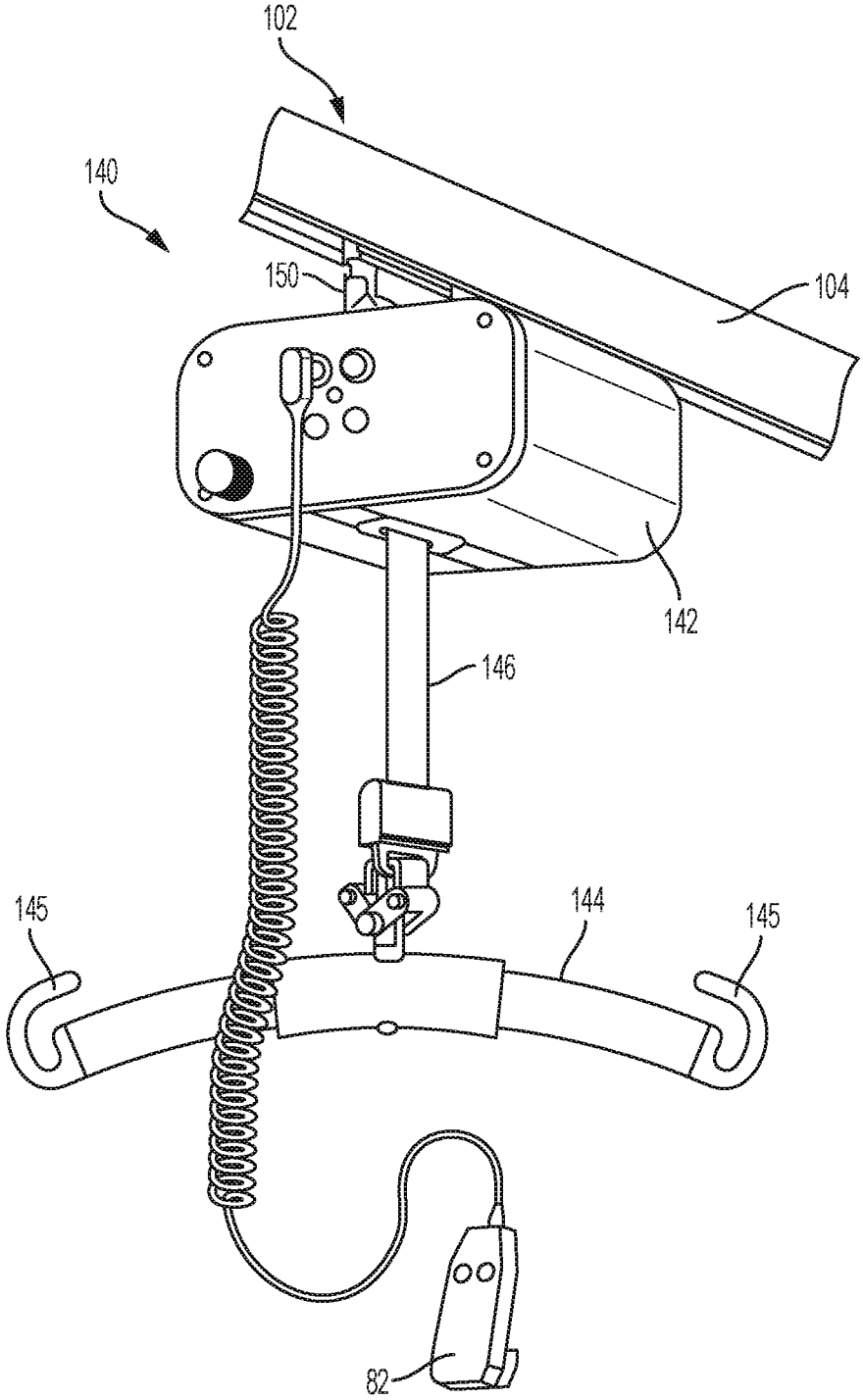
FIG. 2 schematically depicts the a lift unit of the overhead lift system of FIG. 1, according to one or more embodiments shown and described herein.

Referring to FIG. 2, an exemplary lift unit 140 is schematically depicted. As will be described in greater detail herein, the lift unit 140 is configured to be slidably engaged with and travel along the overhead rail 102 to transport a subject coupled to the lift unit 140. The lift unit 140 includes a lift motor 142 and a carriage 150 that engages the overhead rail 102 such that the lift unit 140 is translatable therealong on support wheels (e.g., support wheels 154*a*, 154*b*, 154*c*, and 154*d* illustrated in FIGS. 3 and 4) as indicated by direction 52 (FIG. 1). In some embodiments, the lift motor 142 (or a separate motor) may be operatively coupled to the support wheels 154*a-d* to cause the support wheels 154*a-d* to rotate such that the lift unit 140 is capable of translating across the overhead rail 102. In some embodiments, the support wheels 154*a-d* may not be motorized. The lift motor 142 may include a power supply such as a battery or other voltage source (not shown).

The lift unit 140 may further include a strap or tether 146 that extends vertically downward from the lift motor 142. The lift motor 142 may be operatively coupled to the tether 146 such that the lift motor 142 can cause a length of the tether 146 to extend or retract from the lift unit 140. A sling bar 144 having hooks 145 is attached to the end 107 of the tether 146 distal from the lift motor 142. A caregiver or other user can use the lift unit 140 to raise and lower a subject. For example, the lift unit 140 can also be used to raise and lower a subject by securing the subject in a sling (not shown), attaching the sling to the sling bar 144 hooks 145, and using a control device 82 (such as a hand control) to operate the lift motor 142. The control device 82 may be configured to control a payout length of the tether 146. Once the subject is in a raised positioned the subject may be conveyed along the overhead rail 102 either manually, or by using the control device 82 to regulate the motion of the lift unit 140 with respect to the overhead rail 102.

Figure 3:
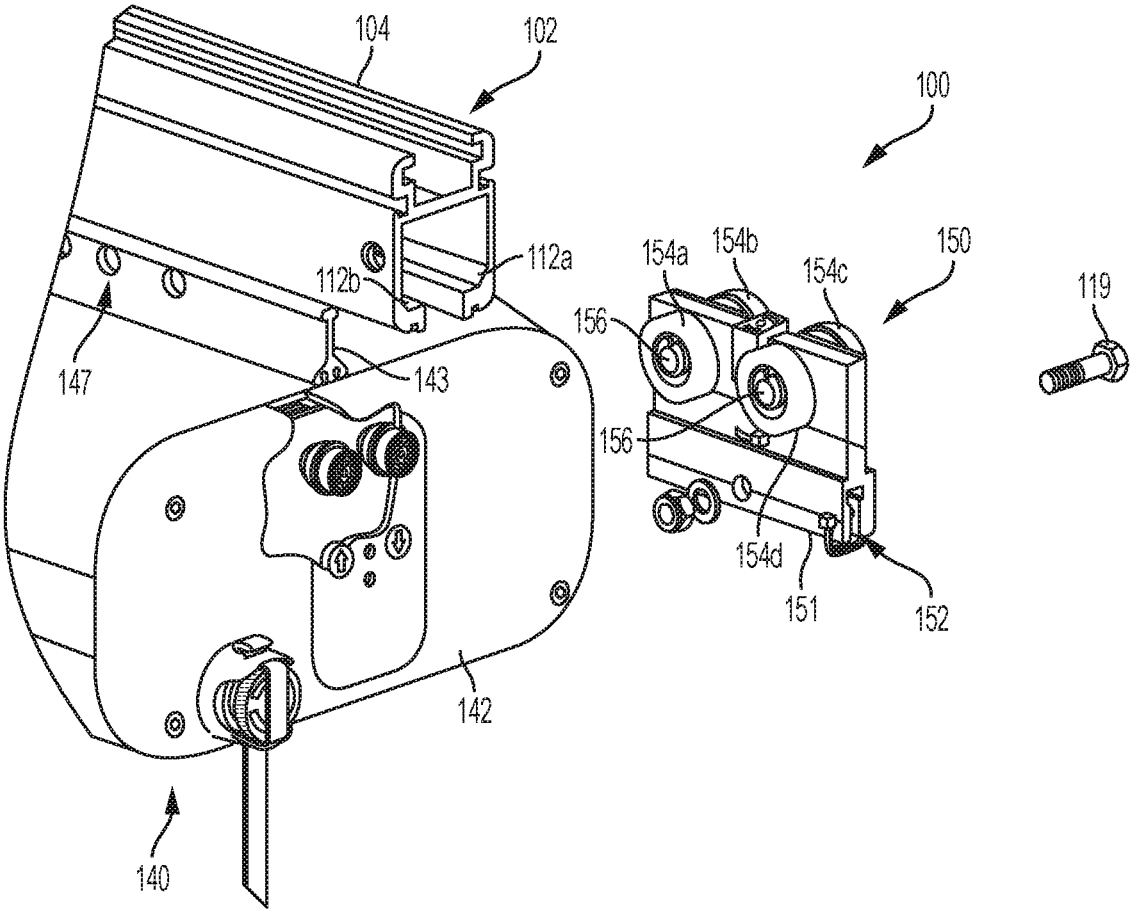
FIG. 3 schematically depicts an exploded view of the lift unit of FIG. 2, according to one or more embodiments shown and described herein.

Referring now to the exploded view of the lift unit 140 schematically depicted in FIG. 3, the lift unit 140 is mechanically coupled to a carriage 150 which facilitates slidably positioning the lift unit 140 along the overhead rail 102. In the embodiments of the lift unit 140 described herein, the lift unit 140 includes a connection rail 143 which is mounted to a top surface of the lift unit 140. The connection rail 143 facilitates connecting and securing the lift unit 140 to the carriage 150. In the embodiment of the lift unit 140 shown in FIG. 3, the connection rail 143 has a T-shaped configuration and the carriage 150 has a receiving slot 152 with a complimentary configuration for receiving the connection rail 143. The carriage 150 may be secured to the connection rail 143 with a fastener 119, such as a bolt and nut as depicted in FIGS. 3 and 4, which extends transversely through openings in the carriage 150 and a corresponding opening 147 in the connection rail 143.

Figure 4:
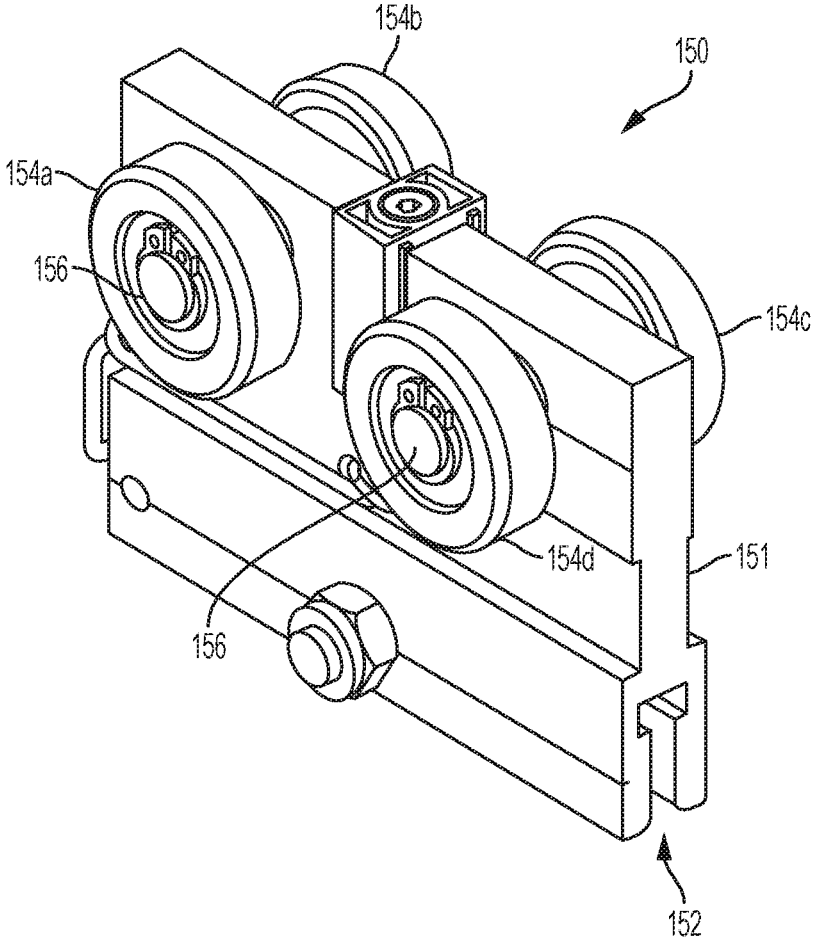
FIG. 4 schematically illustrates a carriage of the lift unit of FIG. 2, according to one or more embodiments shown and described herein.

Referring to FIGS. 3 and 4, the carriage 150 generally comprises a carriage body 151 to which a plurality of support wheels 154*a*, 154*b*, 154*c*, and 154*d* are rotatably attached for supporting the carriage 150 in the rail. The support wheels 154*a*, 154*b*, 154*c*, and 154*d* facilitate positioning the carriage 150 and lift unit 140 along the length of the overhead rail 102. In the embodiments described herein, the carriage 150 is depicted with four support wheels 154*a-d*. However, it is contemplated that the carriage 150 may be constructed with fewer than four support wheels 154*a-d*. For example, in some embodiments, the carriage 150 may be constructed with one or two support wheels (i.e., a pair of support wheels). Accordingly, it should be understood that the carriage 150 includes at least one support wheel. The support wheels 154*a-d* is positioned on axles 156 which extend transversely through the carriage body 151. Each support wheel is secured to the axle 156 with a fastener, such as retaining clips, such that the support wheels 154*a* are rotatable on the axle 156.

As noted above, in some embodiments, the lift motor 142 or a similar drive mechanism may be operatively coupled to the support wheels 154*a-d* to cause the lift unit 140 to traverse the overhead rail 102. In such embodiments, the drive mechanism may be communicatively coupled to the control device 82 which actuates the drive mechanism and facilitates traversing the lift unit 140 along the overhead rail 102 with the drive mechanism. However, in other embodiments, the support wheels 154*a-d* may be passive (i.e., the support wheels 154*a* are not actively driven with a motor or a similar drive mechanism) and the lift unit 140 is manually traversed along the rail.

Referring again to FIG. 1, the overhead rail 102 is schematically depicted. As illustrated, the overhead rail 102 may be secured to the ceiling 14 of the care room. Specifically, the overhead rail 102 may be secured to structural elements of the ceiling 14, such as ceiling joists, by suitable fastening elements. In some embodiments, the overhead rail 102 may be suspended from the ceiling 14 of the care room by pendants 105. In other embodiments, it is contemplated that the overhead rail 102 may be directly secured to the ceiling 14. The overhead rail 102 includes a subject support portion 104 and a docking portion 106 removably coupled to an end of the subject support portion 104, such as proximity coupling (i.e., butt-coupling) or otherwise. In some embodiments, the overhead rail 102 includes a transit switch portion 110 positioned laterally between the subject support portion 104 and the docking portion 106. In embodiments, the transit switch portion 110 is disposed between the subject support portion 104 and the docking portion 106 of the overhead rail 102. In embodiments, the transit switch portion 110 couples the subject support portion 104 of the overhead rail 102 to the docking portion 106 of the overhead rail 102.

The subject support portion 104 of the overhead rail 102 is coupled to the ceiling 14 of the care room and is capable of supporting a weight of a subject being transported along the subject support portion 104 in a direction 52 parallel with the overhead rail 102. As illustrated, the subject support portion 104 may be secured to the ceiling 14 with pendants 105. A subject may be moved along the subject support portion 104 by the lift unit 140. For example, as noted above, the lift unit 140 may include a harness or sling (not shown), that may hold a subject. The lift unit 140 may thus transport the subject along the overhead rail 102.

The docking portion 106 of the overhead rail 102 is engaged with an elevator track 120 such that the docking portion 106 is translatable with respect to the elevator track 120. That is, the docking portion 106 is configured to travel up and down the elevator track 120 in the direction 108 which, in the embodiment depicted in FIG. 1, is generally parallel to the elevator track 120. In the embodiment depicted in FIG. 1, the elevator track 120 is generally perpendicular to the overhead rail 102. However, it should be understood that other orientations of the elevator track 120 are contemplated and possible, including orientations where the elevator track 120 is oriented at an oblique angle with respect to the overhead rail 102.

Still referring to FIG. 1, the docking portion 106 includes a proximal end 107 directed toward the subject support portion 104 and a distal end 109 positioned opposite the proximal end 107 so as to be directed away from the subject support portion 104. In some embodiments, the docking portion 106 is mounted onto the elevator track 120 at the distal end 109, such as illustrated in FIG. 1. In other embodiments, it is contemplated that the docking portion 106 is mounted on the elevator track 120 at a different location such as between the distal end 109 and the proximal end 107 such as illustrated in FIGS. 6-11. The docking portion 106 may have a width along direction 52 that is wide enough to support the lift unit 140 completely thereon such that no portion of the lift unit 140 remains supported on the subject support portion 104 when the lift unit 140 is positioned within the docking portion 106.

In the embodiments, the elevator track 120 may be mounted to a wall (e.g., wall 20) by any suitable fastening elements. By mounting the elevator track 120 along a wall, the wall may provide additional stability and support to the elevator track 120. However, in other embodiments, the elevator track 120 may be a free-standing track extending between the ceiling 14 and the floor 12. In some embodiments, the elevator track 120 may only extend across a portion of the distance between the ceiling 14 and the floor 12. In either case, the elevator track 120 extends at least to a height, H1 (see FIG. 11), of the overhead rail 102 so that the docking portion 106 may be aligned with the subject support portion 104 such that the lift unit 140 can travel from the subject support portion 104 to the docking portion 106. As described hereinabove, the elevator track 120 may be oriented perpendicularly to the overhead rail 102 or at an oblique angle with respect to the overhead rail 102.

Figure 5:
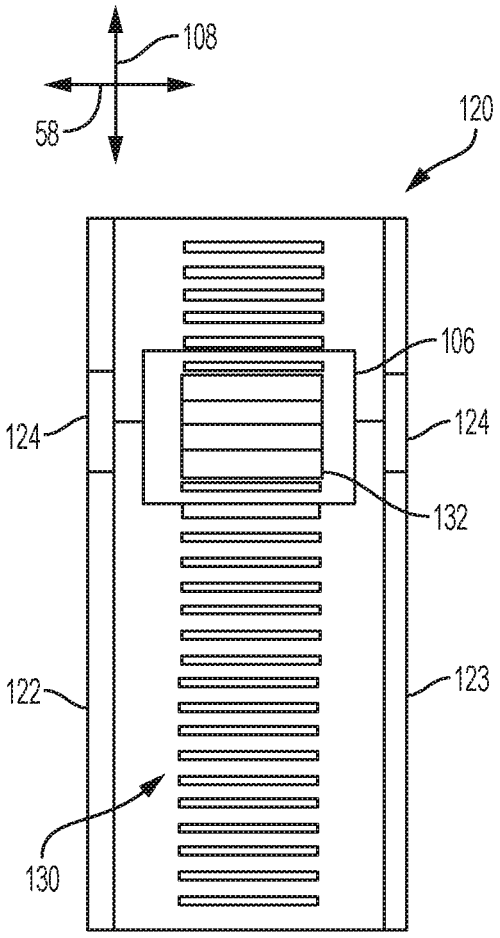
FIG. 5 schematically illustrates a front view of a docking portion of a overhead lift system traversing an elevator track, according to one or more embodiments shown and described herein.
Figure 6:
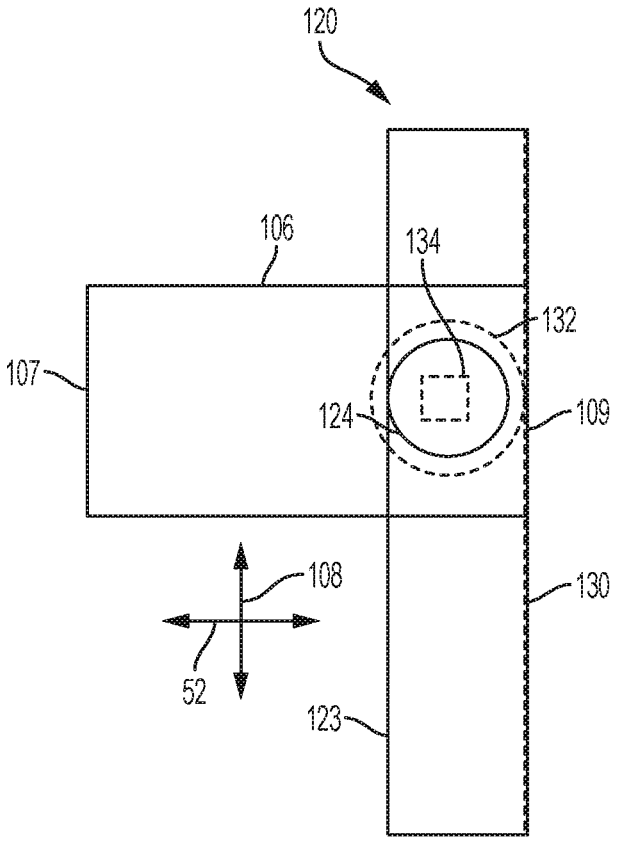
FIG. 6 schematically illustrates a side view of the docking portion of the overhead lift system of FIG. 5 traversing the elevator track, according to one or more embodiments shown and described herein.

Referring to FIGS. 5 and 6, the docking portion 106 mounted on the elevator track 120 is illustrated in isolation from the rest of the overhead lift system 100. In this embodiment, the docking portion 106 is illustrated as being mounted to the elevator track 120 at the distal end 109 of the docking portion 106. However, it is contemplated that the docking portion 106 may be mounted on the elevator track 120 so as to be translatable up and down the elevator track 120 in any conventional way. For example, in one embodiment, the docking portion 106 is engaged with the elevator track 120 through a rack and pinion (e.g., cog and track) configuration. For example, the elevator track 120 may include a rack 130 extending along direction 108. The docking portion 106 is coupled to the rack 130 through one or more pinion gears 132. The teeth of the pinion gear(s) 132 mesh with the teeth of the rack 130 to allow the docking portion 106 to translate up and down the elevator track 120 as the pinion gear(s) 132 rotates. For example, when the pinion gear(s) 132 rotates in a clockwise direction, the docking portion 106 may travel up the elevator track 120. When the pinion gear(s) rotates in a counterclockwise direction, the docking portion 106 may travel down the elevator track 120.

In embodiments, the elevator track 120 may include guide rails (e.g., 122, 123) positioned on either side of the rack 130 in direction 58 and extending along direction 108 so as to be parallel with the rack 130 and to keep the pinion gear(s) 132 in alignment with and engaged with the rack 130. For example, the elevator track 120 may include a first guide rail 122 positioned to one side of the rack 130 and a second guide rail 123 positioned on the opposite side of the rack 130 from the first guide rail 122. Guide wheels 124 may be coupled to the docking portion 106 and secured within the guide rails 122, 123 to align the docking portion 106 with the elevator track 120. In embodiments, the guide wheels 124 may be coaxial with the pinion gear(s) 132 and may be configured to rotate with the pinion gear(s) 132.

In some embodiments the pinion gear(s) 132 may be operatively coupled to a motor 134, such as the armature (not shown) of the motor 134. The motor 134 facilitates motorized travel of the docking portion 106 along the elevator track 120. In embodiments, the motor 134 may be, for example, a reversible motor. The motor 134 may be used to rotate the pinion gear(s) 132 in either a clockwise or counterclockwise direction. In some embodiments, a control unit, such as control device 82 (FIG. 2), may be communicatively coupled to the motor 134 to cause the motor 134 to translate the docking portion 106 up and down the elevator track 120. In other embodiments, the pinion gear may be operatively coupled to a crank (not shown) and pawl clutch that may be manually rotated in either a clockwise or counterclockwise direction to translate the docking portion 106 up and down the elevator track 120.

Referring again to FIG. 1, in some embodiments, the overhead rail 102 may further include a transit switch portion 110, as referenced hereinabove. As used herein, the transit switch portion 110 refers to any structure along the overhead rail 102 that is operable to either allow or prevent a lift unit 140 from traveling from the subject support portion 104 of the overhead rail 102 into the docking portion 106 of the overhead rail 102. It is noted that though the transit switch portion 110 is illustrated as enlarged relative to the rest of the overhead rail 102 for emphasis, there need not be any size difference between the transit switch portion 110 and the rest of the overhead rail 102. However, it is contemplated that the transit switch portion 110 may include an enlarged structure wherein a portion of either the subject support portion 104 and/or the docking portion 106 is positioned within the transit switch portion 110 when the docking portion 106 is aligned with the subject support portion 104.

Figure 7:
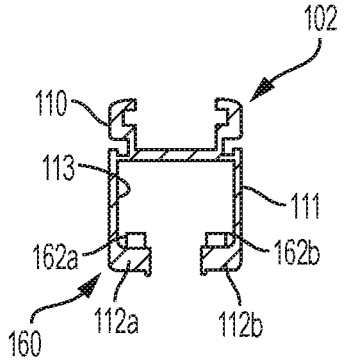
FIG. 7 schematically illustrates a transit switch portion of an overhead lift system, according to one or more embodiments shown and described herein.
Figure 8A:
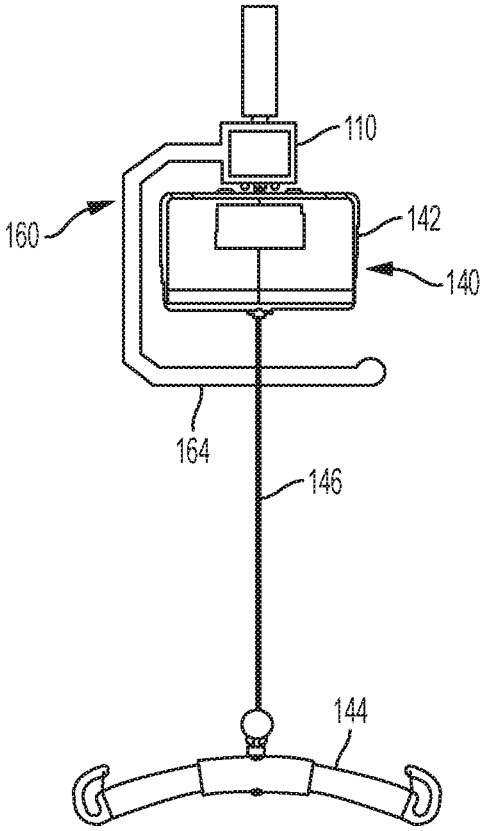
FIG. 8A schematically illustrates a transit switch portion of an overhead lift system, according to one or more embodiments shown and described herein.
Figure 8B:
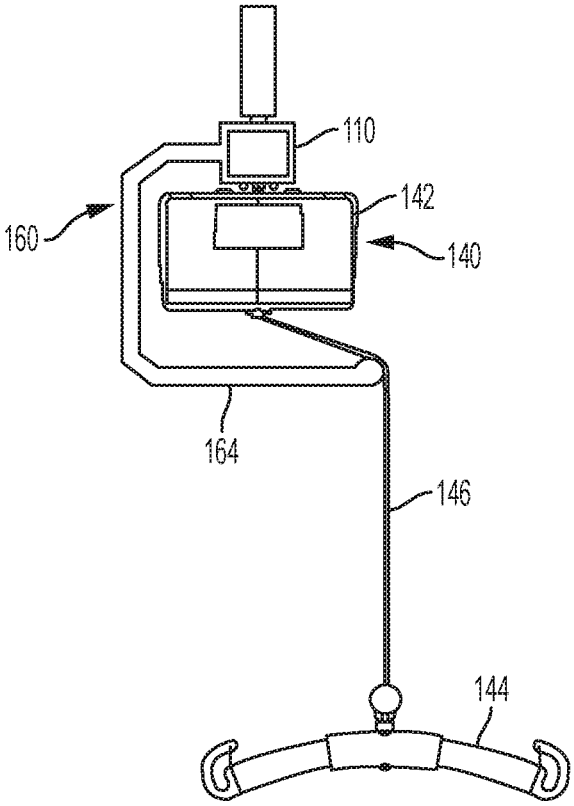
FIG. 8B schematically illustrates the adjustment of a lift unit to move through the transit switch of FIG. 8A, according to one or more embodiments shown and described herein.

Referring now to FIG. 7, FIG. 7 schematically depicts a cross-sectional view of one embodiment of an overhead rail 102. In particular, FIG. 7 illustrates a cross-sectional view of one embodiment of a transit switch portion 110 of the overhead rail 102. In this embodiment, the overhead rail 102 includes a body 111 having an interior contour 113. It is noted that the interior contour 113 of the overhead rail 102 is generally constant across various portions of the overhead rail 102. For example, the interior contour 113 is the same throughout the subject support portion 104, the transit switch portion 110, and the docking portion 106. The body 111 includes first flange 112*a* and a second flange 112*b* upon which the lift unit 140 may be supported. Particular to the transit switch portion 110, it is contemplated that the transit switch portion 110 may include a locking device 160 either within an interior of the transit switch portion 110 as defined by the interior contour 113, exterior to the body 111 of the transit switch portion 110, such as illustrated in FIGS. 8A and 8B, or a combination thereof. The locking device 160 can be any device configured to prevent the lift unit 140 from traveling from the subject support portion 104 into the docking portion 106.

Still referring to FIG. 7, in one embodiment, the locking device 160 includes a deformable material disposed on at least one of the first flange 112*a* and the second flange 112*b*. The deformable material may be, for example, an elastomeric material having a Shore hardness which enables the deformable material to be elastically deformed under a predetermined applied load. The deformable material may include, for example, rubber or the like. In embodiments, the locking device 160 may include a first portion 162*a* of the deformable material disposed on the first flange 112*a* and a second portion 162*b* of the deformable material disposed on the second flange 112*b*. In some embodiments, only one of the first flange 112*a* and the second flange 112*b* has deformable material disposed thereon. The deformable material may be fixed on at least one of the first flange 112*a* and the second flange 112*b* through any conventional joining technique, such as, for example, adhesively bonding the deformable material to the at least one of the first flange 112*a* and the second flange 112*b*.

The deformable material is selected and configured to prevent the lift unit 140 from traveling into the docking portion 106 of the overhead rail 102 when the lift unit 140 is supporting a load that exceeds a predetermined amount. For example, a load that exceeds a predetermined amount may include any load applied by the lift unit 140 in excess of the weight of the lift unit 140 itself. In some embodiments, the load that exceeds the predetermined amount may include, for example and without limitation, about 5 lbs greater than the weight of the lift unit 140, about 10 lbs greater than the weight of the lift unit 140, about 20 lbs greater than the weight of the lift unit 140. As an example, when the lift unit 140 traverses the first and second flanges 112*a*, 112*b* having the deformable material disposed thereon, if the lift unit 140 is carrying the weight of a subject, the lift unit 140 (specifically the support wheels 154*a-d* of the lift unit 140) will sink into the deformable material and will be prevented from further movement into the docking portion 106. When the lift unit 140 is not supporting a subject, the lift unit 140 may traverse over the deformable material without substantially deforming the deformable material so as to be able continue into the docking portion 106 of the overhead rail 102.

In a similar embodiment (not depicted), the locking device 160 may include a plate supported by a spring instead of a deformable material. The plate may form a portion of the surface of one of the flanges 112*a*, 112*b* in the interior contour 113 of the overhead rail 102. In its unloaded state (i.e., with only the load of the lift unit 140 applied), the plate is flush with the surfaces of the flanges 112*a*, 112*b*, thereby allowing the lift unit 140 to pass back and forth between the docking portion 106 of the overhead rail 102 and the subject support portion 104 of the overhead rail 102. However, when a load is applied to the lift unit 140, and the load exceeds the predetermined threshold, the applied load may cause the spring to compress, lowering the plate below the surface of one of the flanges 112*a*, 112*b*, thereby creating a recess in the flanges 112*a*, 112*b* of the transit switch portion 110 of the overhead rail 102. This recess prevents the lift unit 140 from proceeding into the docking portion 106 of the overhead rail 102.

Referring now to FIGS. 8A and 8B, another embodiment of a locking device 160 is schematically illustrated. In this embodiment, a bar 164 extends from the transit switch portion 110, around a path of a lift motor 142 of the lift unit 140, and then beneath the path of the lift motor 142. In some embodiments, the bar 164 extends beneath a bottom surface of the lift motor 142 and is oriented substantially parallel with the bottom surface of the lift motor 142. In other embodiments, it is contemplated that the bar 164 may extend beneath the bottom surface of the lift motor 142 at an acute angle relative to the bottom surface of the lift motor 142. In either case, the bar 164 should be positioned so as to be an obstacle for at least a portion of the lift unit 140 as the lift unit 140 attempts to pass the transit switch portion 110 of the overhead rail 102. For example, the bar 164 may extend below a bottom surface of the lift motor 142, so that as the lift unit 140 attempts to pass the locking device 160 of the transit switch portion 110, a portion of the lift unit 140 contacts the bar 164 and prevents the lift unit 140 from moving into the docking portion 106 of the overhead rail 102 system. In the illustrated embodiments, the bar 164 is positioned in the path of the tether 146 of the lift unit 140. If it is determined that the lift unit 140 should be allowed to pass into the docking portion 106 of the overhead rail 102, the tether 146 may be manually manipulated so as to be directed around the bar 164 (as shown in FIG. 8B). As such, the lift unit 140 can continue into the docking portion 106 of the overhead rail 102.

Figure 9:
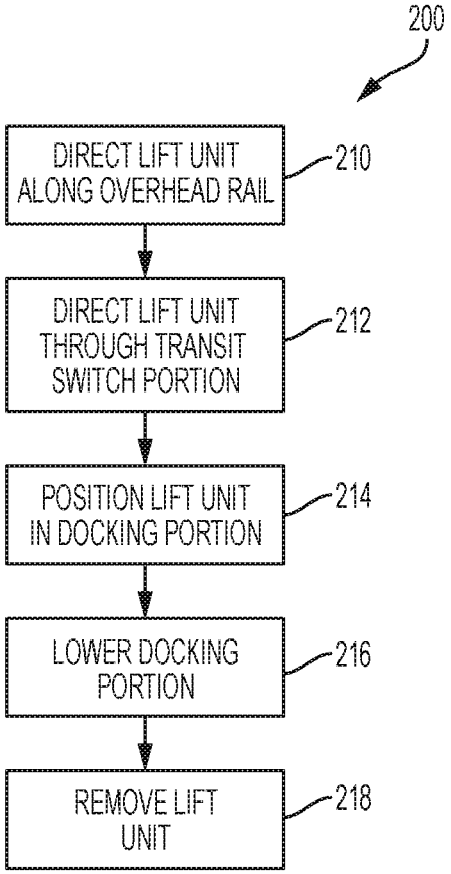
FIG. 9 schematically illustrates a method of removing an overhead lift from an overhead lift system, according to one or more embodiments shown and described herein.
Figure 10:
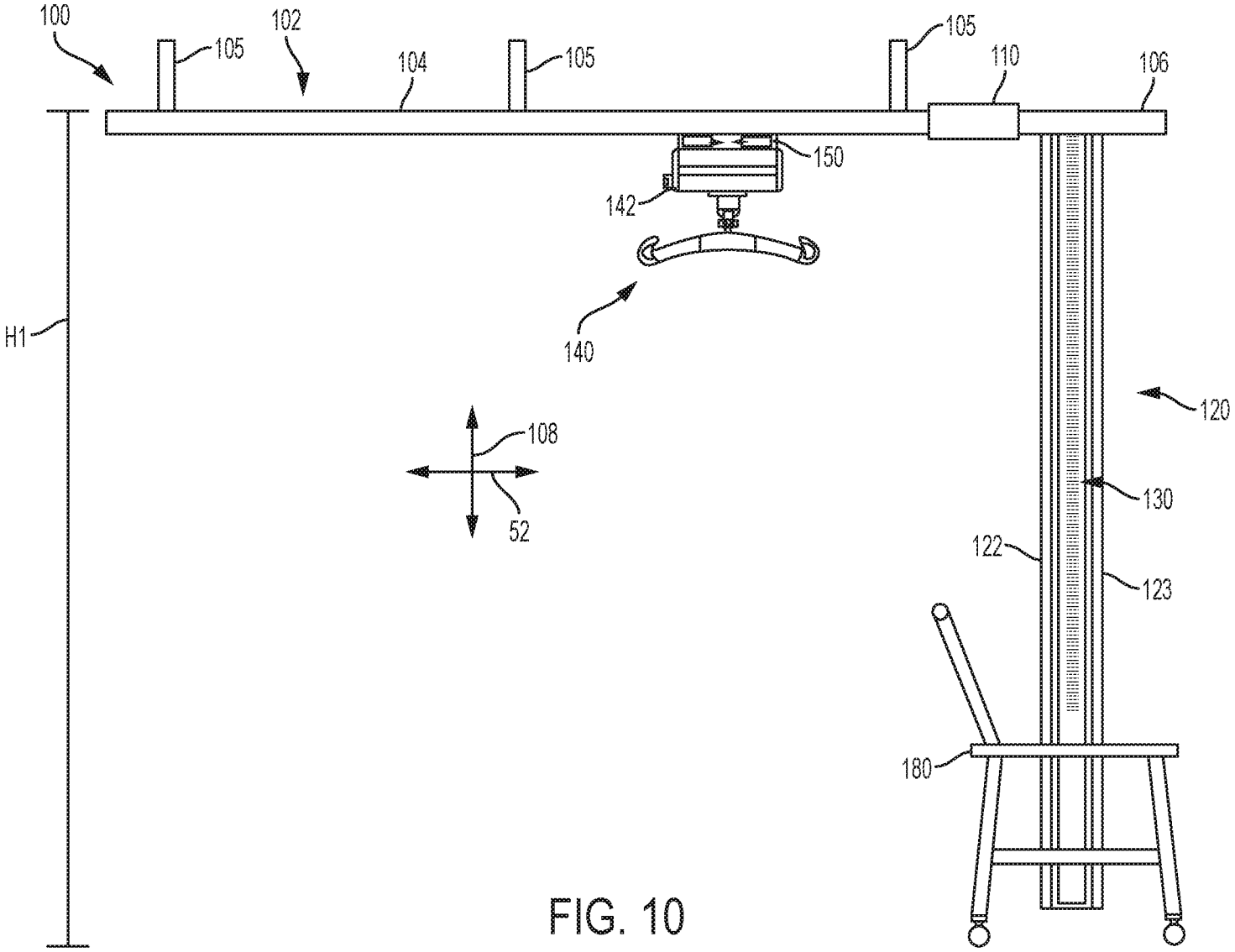
FIG. 10 schematically illustrates an overhead lift system, according to one or more embodiments shown and described herein.
Figure 11:
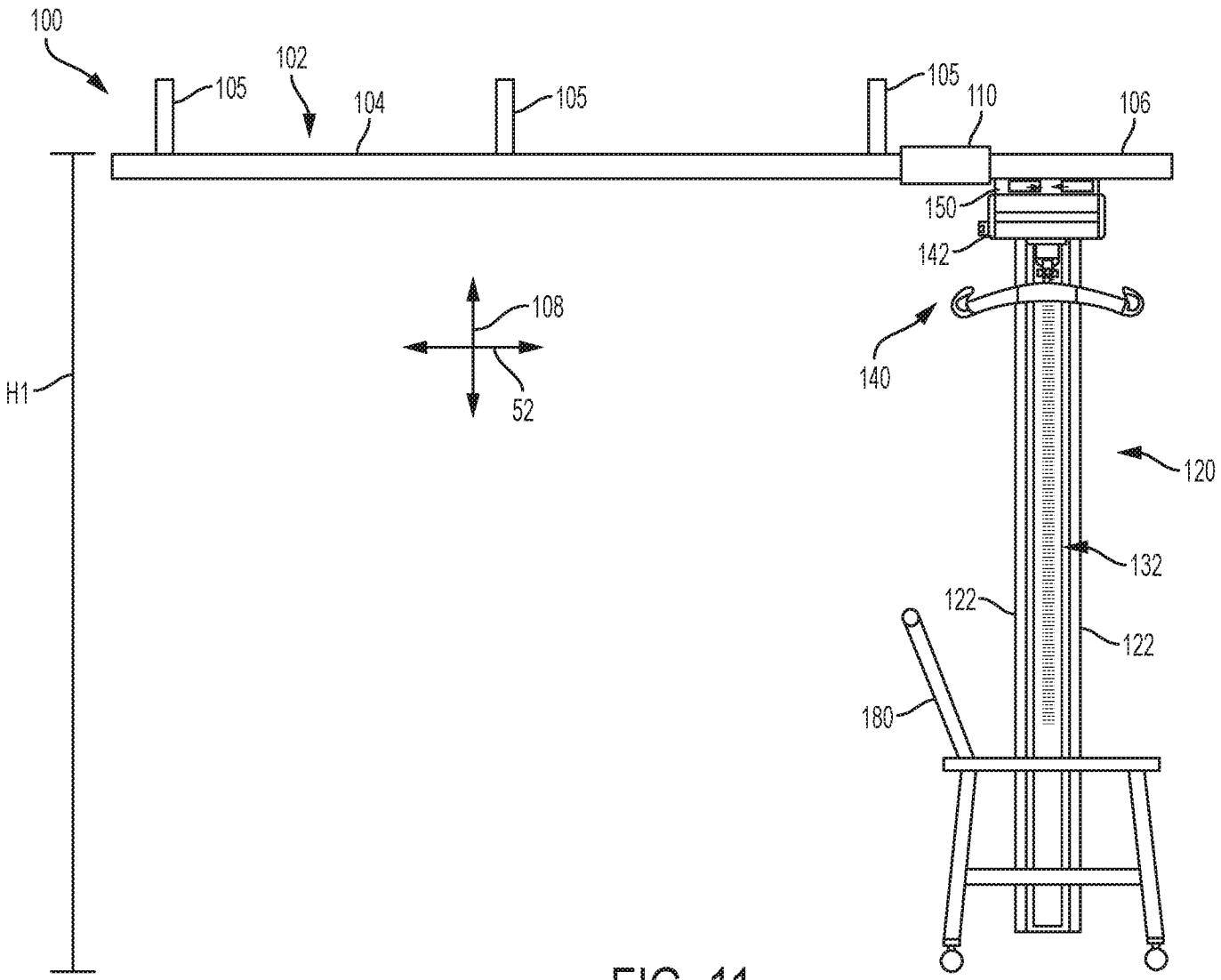
FIG. 11 schematically illustrates a lift unit positioned within a docking portion of the overhead lift system of FIG. 10, according to one or more embodiments shown and described herein.

Referring now to FIG. 9, a flow diagram 200 illustrating a method of transporting a lift unit 140 is generally depicted. The method is best understood in conjunction with FIGS. 10-15. It is noted that though the method as illustrated appears to include a certain number of discrete steps, it is contemplated that more or less steps may be taken without departing from the scope of the present disclosure. To dismount a lift unit 140 from an overhead rail 102, the lift unit 140 is directed along an overhead rail 102 to a docking portion 106 of the overhead rail 102 (block 210). Referring to FIG. 10, the lift unit 140 is illustrated as being positioned within the subject support portion 104 of the overhead rail 102 and traveling toward the docking portion 106. The lift unit 140 may be directed through the transit switch portion 110 of the overhead rail 102 (block 212). Though not shown in the figure, the transit switch portion 110 may include a locking device 160 as described herein above to selectively stop the lift unit 140 from entering the docking portion 106 when a load is applied to the lift unit 140, such as the load of a subject attached to the lift unit 140. In some embodiments, the locking device 160 may only stop the lift unit 140 from entering the docking portion 106 when the lift unit 140 is supporting a load of a predetermined weight (e.g., greater that 10 lbs, greater than 5 lbs, greater than 3 lbs and the like.) In some embodiments, the locking device 160 is not dependent upon a weight of a load carried by the lift unit 140. Once the lift unit 140 has traversed the transit switch portion 110 of the overhead rail 102, the lift unit 140 is positioned within the docking portion 106 of the overhead rail 102 (block 214). FIG. 11 illustrates the lift unit 140 positioned within the docking portion 106 so as to be completely supported by the docking portion 106 of the overhead rail 102.

Figure 12:
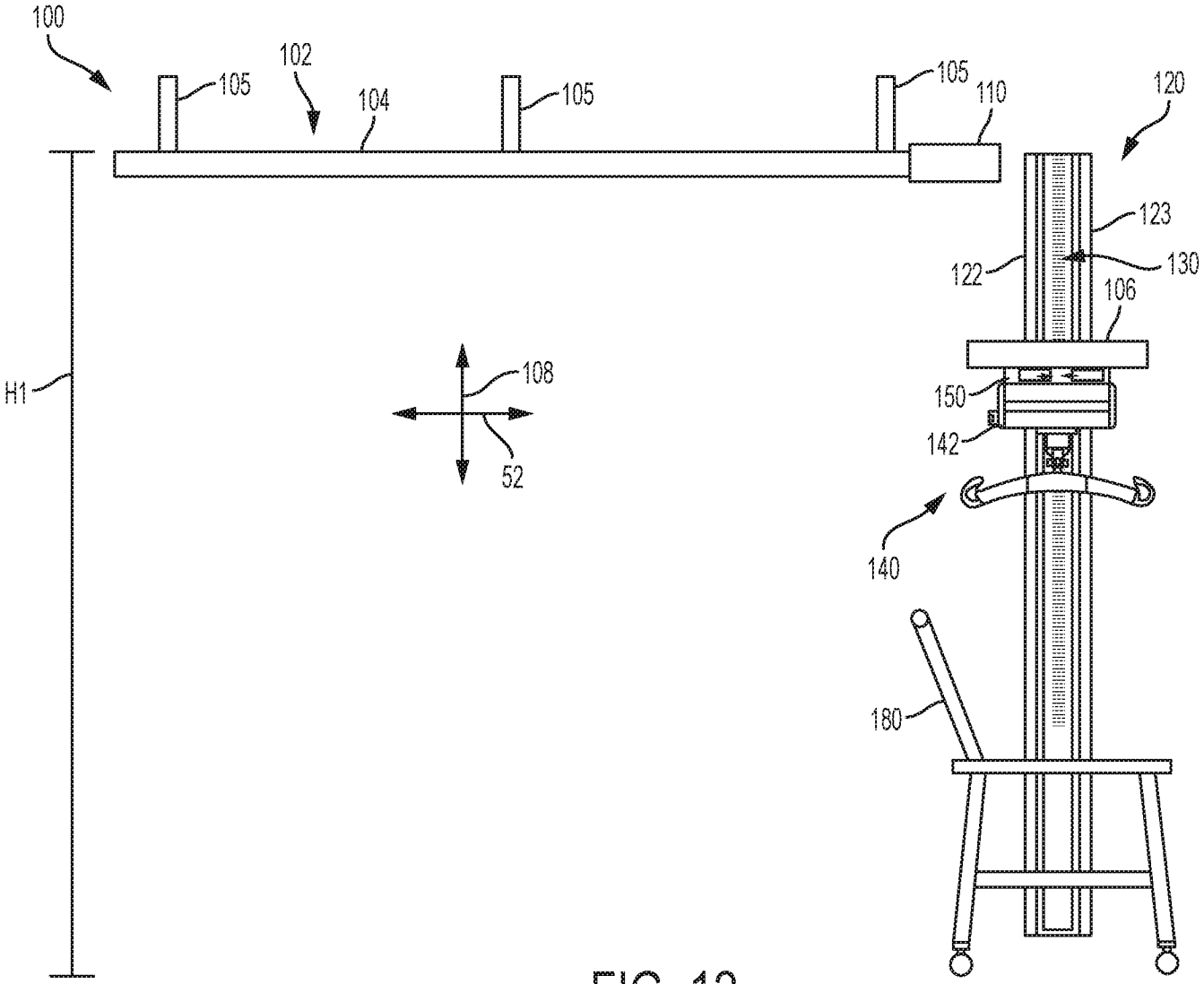
FIG. 12 schematically illustrates the docking portion and lift unit traversing an elevator track of the overhead lift system of FIG. 10, according to one or more embodiments shown and described herein.
Figure 13:
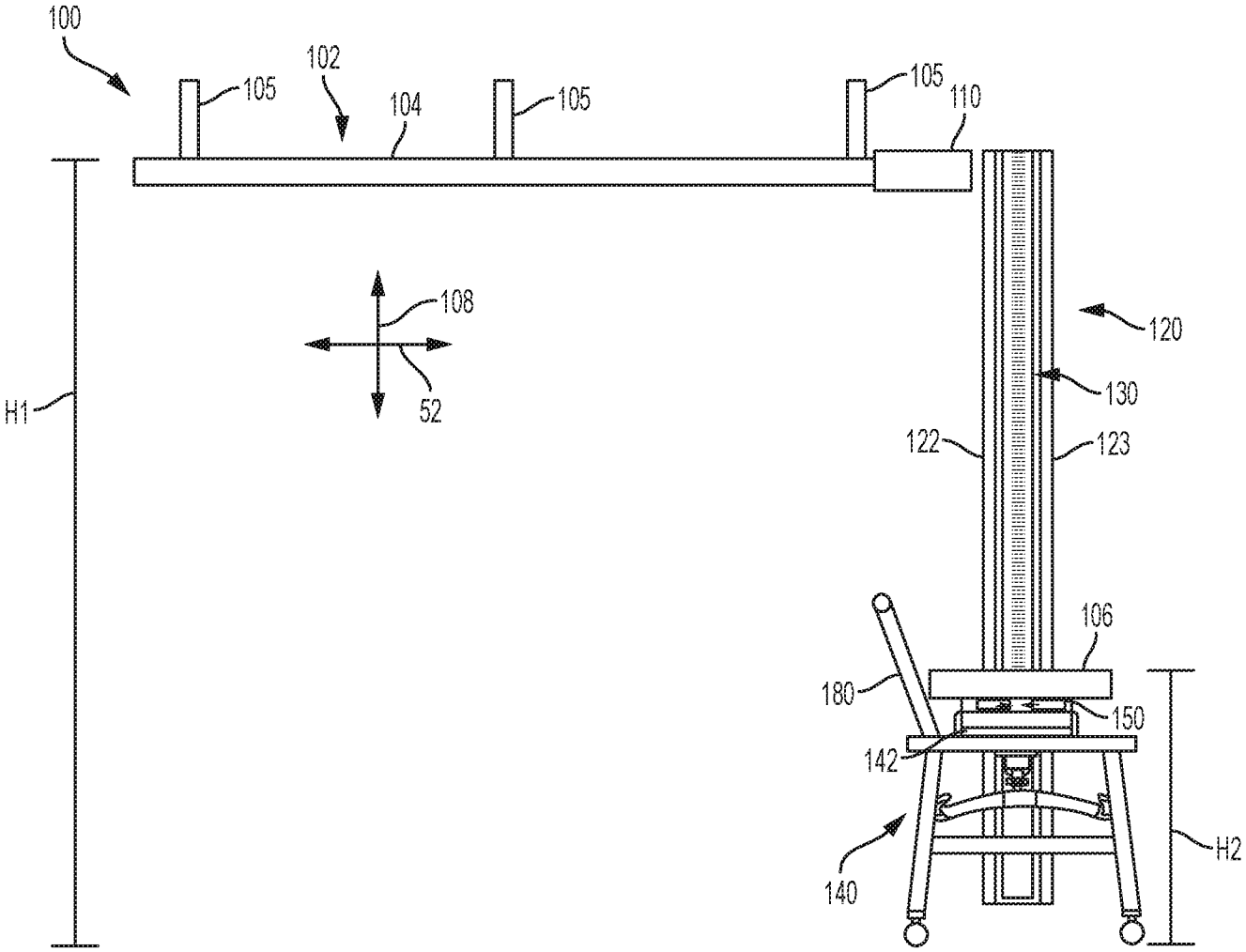
FIG. 13 schematically illustrates the lift unit positioned within a cart positioned at the base of the elevator track of FIG. 10, according to one or more embodiments shown and described herein.
Figure 14:
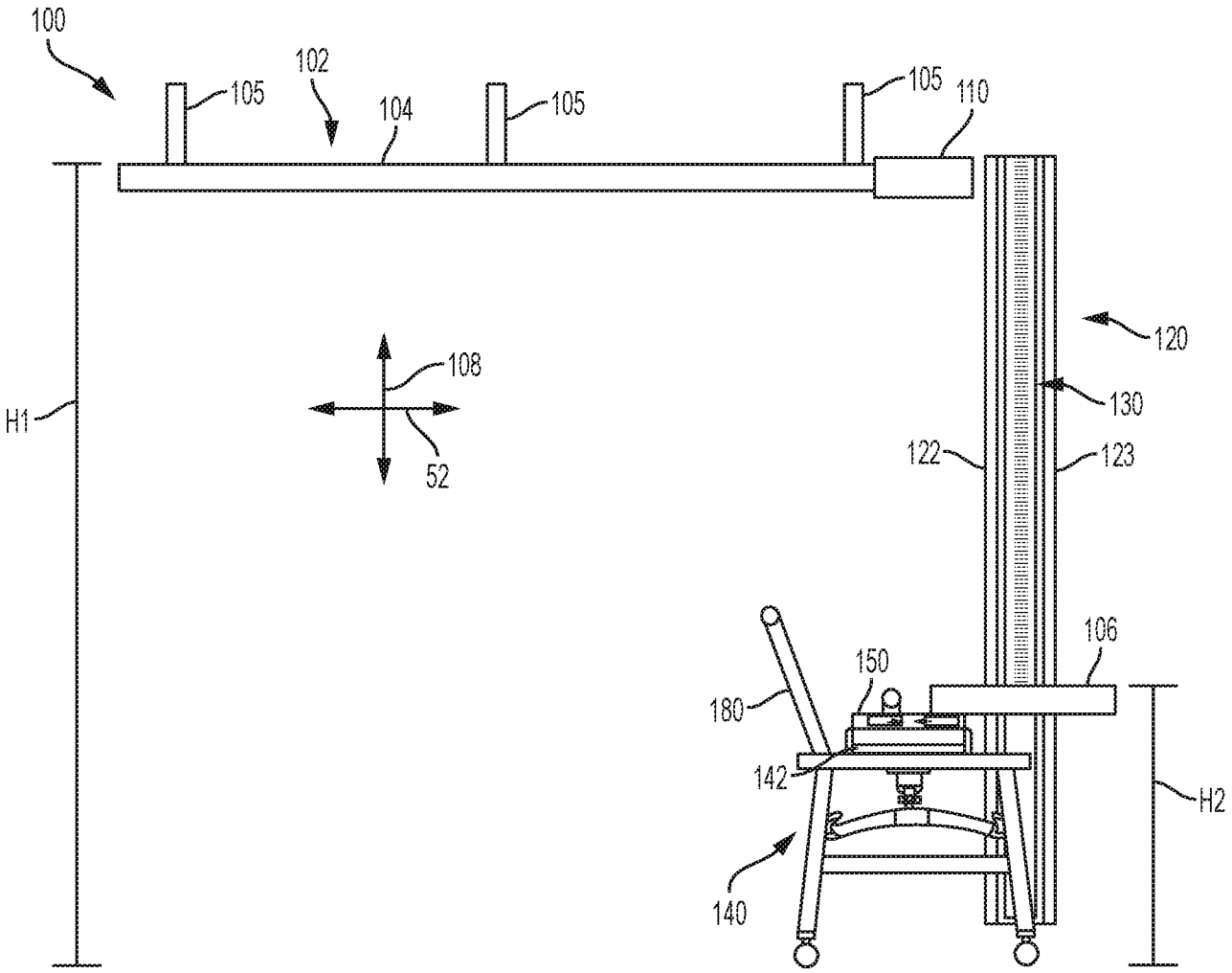
FIG. 14 schematically illustrates the lift unit being guided from the docking portion with the cart of FIG. 13, according to one or more embodiments shown and described herein.
Figure 15:
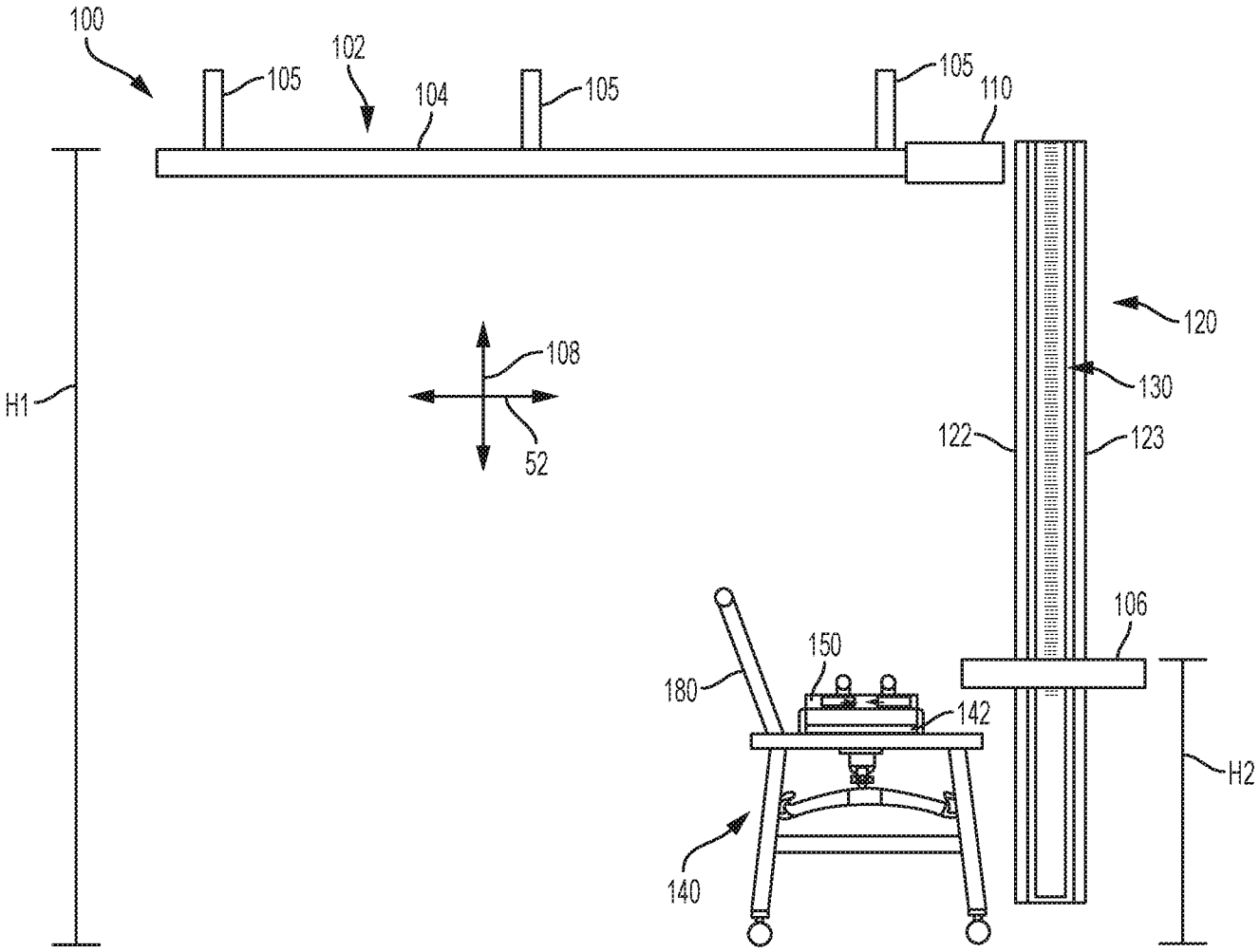
FIG. 15 schematically illustrates the lift unit completely dismounted from the docking portion of FIG. 13, according to one or more embodiments shown and described herein.

Once the lift unit 140 is supported completely within the docking portion 106 of the overhead rail 102, the docking portion 106 can be lowered along the elevator track 120 to a position below a height H1 of the subject support portion 104 of the overhead rail 102 (block 216). FIG. 12 illustrates the docking portion 106 traveling down the elevator track 120 while supporting the lift unit 140 thereon. Referring now to FIG. 13 the lift unit 140 can be lowered down to a waiting cart 180 that is configured to hold the lift unit 140 thereon. Once the lift unit 140 is supported within the cart 180, or once positioned at a desired height H2 below the height H1 of the overhead rail 102, the lift unit 140 can be removed from the docking portion 106 (block 218) by sliding the carriage 150 out of the docking portion 106. As illustrated in FIG. 14, the cart 180 is translated relative to the docking portion 106 in a direction 52 parallel to the overhead rail 102 so as to slide the carriage 150 of the lift unit 140 from the docking portion 106.

Once the lift unit 140 is removed from the docking portion 106, the lift unit 140 can be serviced and/or moved to another overhead lift system 100. The lift unit 140 can be remounted onto an overhead lift system 100 by performing the steps above in reverse order. For example, an unloaded docking portion 106 can be lowered to a height that the carriage 150 of the lift unit 140 can be slid onto the docking portion 106. The docking portion 106 can then traverse up the elevator track 120 to align the docking portion 106 with a subject support portion 104 of the overhead rail 102. Once aligned, the lift unit 140 can be caused to travel off of the docking portion 106 so as to be supported on the subject support portion 104, wherein the lift unit 140 can be used to transport a subject as described herein.

In the embodiments described herein and shown in the figures, the overhead rail 102 of the overhead lift system 100 is constructed with the docking portion 106 and the elevator track 120 to facilitate mounting and dismounting a lift unit 140 in the overhead rail 102. However, it is also contemplated that certain components of the overhead lift system 100 may be separately provided as a kit of parts which are packaged together and may be used to retro fit overhead lift systems which do not the capability of raising and lowering a lift unit 140 to facilitate mounting and dismounting the lift unit 140 on the overhead rail 102. For example, in one embodiment, a kit of parts for retrofitting an overhead lift system for raising and lowering a lift unit 140 may include a docking portion 106 of the overhead rail 102 and the elevator track 120 packaged together. In these embodiments, the docking portion 106 and the elevator track 120 may be constructed as described herein. In one embodiment, the kit of parts may further include a transit switch portion 110 of the overhead rail 102 as described herein. The kit of parts may further include a cart 180 for receiving a dismounted lift unit 140.

As noted above, the kit of parts may be used to retrofit and convert an existing overhead lift system to an overhead lift system which is capable of raising and lowering a lift unit 140 to facilitate mounting and dismounting the lift unit 140 in the overhead rail 102. The various parts of the kit of parts may be installed on the overhead rail 102 of the existing lift system as described herein above thereby converting the existing overhead lift system to an overhead lift system capable of raising/lowering a lift unit 140.

It is noted that though the present disclosure is directed to overhead lift systems 100 that are used to transport subjects, such overhead lift systems 100 may be useful in other industries wherein objects, not limited to people, are moved using overhead lift systems 100.

It should now be understood that overhead lift systems include overhead rails having a docking portion that is configured to travel along an elevator track to allow a lift unit to be transported from an overhead rail to a height that is more easily accessible by an operator and/or servicer of the lift unit. As such the lift unit can more easily be removed from an overhead rail and transported to another location or be serviced. This can eliminate a need for ladders or other structures that would otherwise cause an operator to ascend to a height of the overhead rail system and manually remove the lift unit for transport or servicing. As such, potentially hazardous conditions caused by climbing to such heights or the possibility of damaging the lift unit by dropping the lift unit from such a height may be avoided.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An overhead lift system for supporting a person with a lift unit, the overhead lift system comprising:

an overhead rail comprising a subject support portion, a docking portion, a transit switch portion positioned laterally between the subject support portion and the docking portion, wherein an end of the docking portion is removably coupled to an end of the subject support portion through the transit switch portion, and each of the subject support portion, the docking portion, and the transit switch portion comprises a body comprising a first flange and a second flange configured to support the lift unit thereon; and an elevator track coupled to the docking portion such that the docking portion is moveable on the elevator track with respect to the subject support portion of the overhead rail, wherein the elevator track is configured to convey the docking portion of the overhead rail from a height of the subject support portion of the overhead rail toward a position below the height of the subject support portion of the overhead rail.

2. The overhead lift system of claim 1, wherein the elevator track is perpendicular to the overhead rail.

3. The overhead lift system of claim 1, wherein the docking portion comprises a motor engaged with the elevator track, the motor translating the docking portion along the elevator track.

4. The overhead lift system of claim 1, wherein the transit switch portion comprises a locking device that selectively prevents the lift unit from entering the docking portion of the overhead rail when the lift unit is coupled to the overhead rail and the lift unit is carrying a load that exceeds a predetermined amount.

5. The overhead lift system of claim 4, wherein the locking device comprises a deformable material that interfaces with the lift unit as the lift unit travels through the transit switch portion, wherein the deformable material deforms upon application of the load above the predetermined amount and prevents the lift unit from entering the docking portion of the overhead rail.

6. The overhead lift system of claim 1, wherein the elevator track comprises a rack and the docking portion is coupled to the rack with a pinion gear.

7. The overhead lift system of claim 6, wherein the docking portion comprises a motor and the pinion gear is rotably coupled to an armature of the motor, whereby rotation of the armature translates the docking portion along the elevator track.

8. An overhead lift system comprising:

an overhead rail comprising a subject support portion, a docking portion, and a transit switch portion, wherein an end of the docking portion is coupled to an end of the subject support portion with the transit switch portion;

an elevator track coupled to the docking portion such that the docking portion is moveable on the elevator track with respect to the overhead rail, wherein the elevator track is configured to convey the docking portion of the overhead rail from a height of the subject support portion of the overhead rail toward a position below the height of the subject support portion of the overhead rail; and a lift unit slidably engaged with the overhead rail, wherein:

when the lift unit is positioned within the docking portion, the docking portion is configured to convey the lift unit along the elevator track; and the transit switch portion comprises a deformable material that interfaces with the lift unit as the lift unit travels through the transit switch portion, wherein the deformable material deforms upon application of a load above a predetermined amount and prevents the lift unit from entering the docking portion of the overhead rail when the load of the lift unit is above the predetermined amount.

9. The overhead lift system of claim 8, wherein the elevator track is perpendicular to the overhead rail.

10. The overhead lift system of claim 8, wherein the docking portion comprises a motor engaged with the elevator track, the motor facilitating motorized travel of the docking portion along the elevator track.

11. The overhead lift system of claim 8, wherein the elevator track comprises a rack and the docking portion is coupled to the rack with a pinion gear.

12. The overhead lift system of claim 11, wherein the docking portion comprises a motor and the pinion gear is rotably coupled to an armature of the motor, whereby rotation of the armature translates the docking portion along the elevator track.

13. The overhead lift system of claim 11, wherein the elevator track further comprises a first guide rail and a second guide rail positioned on opposite sides of the rack.

14. The overhead lift system of claim 13, wherein the docking portion further comprises guide wheels engaged with the first guide rail and the second guide rail.

15. The overhead lift system of claim 14, wherein the guide wheels are coaxial with the pinion gear and rotate with the pinion gear.

16. A kit of parts for retrofitting an overhead rail to facilitate raising and lowering a lift unit to and from the overhead rail, the kit of parts comprising:

a docking portion of the overhead rail and a transit switch portion of the overhead rail, wherein the transit switch portion couples the docking portion of the overhead rail to an end of a subject support portion of the overhead rail through the transit switch portion such that the transit switch portion is positioned laterally between the subject support portion and the docking portion, and each of the subject support portion, the docking portion, and the transit switch portion comprises a body comprising a first flange and a second flange configured to support the lift unit thereon; and an elevator track for coupling to the docking portion such that the docking portion is translatable on the elevator track with respect to the subject support portion of the overhead rail.

17. The kit of parts of claim 16, wherein the transit switch portion comprises a deformable material that interfaces with the lift unit as the lift unit travels through the transit switch portion from the subject support portion to the docking portion, wherein the deformable material deforms upon application of a load above a predetermined amount and prevents the lift unit from entering the docking portion of the overhead rail when the load of the lift unit is above the predetermined amount.

18. The kit of parts of claim 16, wherein the transit switch portion comprises a bar that is configured to extend from the transit switch portion and into a path of the lift unit when the lift unit is mounted on the overhead rail to prevent the lift unit from entering the docking portion of the overhead rail.

19. The kit of parts of claim 16, wherein the elevator track comprises a rack and the docking portion is coupled to the rack with a pinion gear.

20. The kit of parts of claim 19, wherein:

the elevator track further comprises a first guide rail and a second guide rail positioned on opposite sides of the rack; and the docking portion further comprises guide wheels engaged with the first guide rail and the second guide rail.

* * * * *